US005638890A

United States Patent [19]

Didion et al.

[11] Patent Number: 5,638,890

[45] Date of Patent: Jun. 17, 1997

[54] INTERLOCKING LINER FOR A CASTING SHAKE-OUT UNIT

[75] Inventors: Michael S. Didion; Charles J. Didion, both of St. Charles, Mo.

[73] Assignee: Didion Manufacturing Company, St. Peters, Mo.

[21] Appl. No.: 323,010

[22] Filed: Dec. 20, 1994

[51] Int. Cl.[6] ..... B22D 29/00; B22D 45/00; F16B 3/04

[52] U.S. Cl. ..... 164/404; 164/131; 164/269; 403/375; 403/345

[58] Field of Search ..... 164/404, 401, 164/131, 5, 269, 270.1; 403/375, 332, 345, 13, 14

[56] References Cited

U.S. PATENT DOCUMENTS

| | | | |
|---|---|---|---|
| 1,920,021 | 7/1933 | Schroeder . | |
| 1,998,649 | 4/1935 | Arden . | |
| 2,249,872 | 7/1941 | Turner . | |
| 3,369,425 | 2/1968 | Runkle et al. . | |
| 3,438,660 | 4/1969 | Steiner . | |
| 3,998,262 | 12/1976 | Didion | 164/404 |
| 4,502,808 | 3/1985 | Didion et al. | 164/401 |
| 4,674,691 | 6/1987 | Didion . | |
| 4,981,581 | 1/1991 | Didion . | |
| 5,016,827 | 5/1991 | Didion | 164/404 |
| 5,095,968 | 3/1992 | Didion | 164/404 |
| 5,165,816 | 11/1992 | Parasin | 403/345 |
| 5,267,603 | 12/1993 | Didion | 164/404 |

FOREIGN PATENT DOCUMENTS

| | | | |
|---|---|---|---|
| 69289 | 5/1949 | Denmark . | |
| 1073147 | 6/1967 | Germany . | |
| 2256023 | 11/1992 | United Kingdom | 403/375 |

*Primary Examiner*—Jack W. Lavinder
*Assistant Examiner*—I.-H. Lin
*Attorney, Agent, or Firm*—Paul M. Denk

[57] ABSTRACT

A casting shake-out unit has an outer cylinder and an inner cylinder. The inner cylinder is made of a plurality of interfitting segments which interlock and cooperate with each other to prevent a segment from falling out of the completed inner cylinder. Each segment includes tongues extending from opposing edges of the segment's body and pockets formed in the body. The pockets of one segment receive at least a part of the tongue of a neighboring segment.

15 Claims, 4 Drawing Sheets

INTERLOCKING LINER FOR A CASTING SHAKE-OUT UNIT

BACKGROUND OF THE APPLICATION

This invention relates to casting shake-out units used to separate or remove sand from castings, and in particular to a liner which forms the inner surface of the shake-out unit.

In the formation of a tumbling mill, such as a casting shake-out unit, rotary separator, media drum, material drier, lump crusher reclaimer, blending drum, sand screen, or the like, it is desirable to form the inner surface of the mill from segments. Thus, when individual segments wear out, they can be replaced easily and rapidly without the need to incur a significant amount of downtime or expense. An example of a shake-out unit having a segmented inner surface or lining is disclosed in U.S. Pat. No. 3,998,262, which is assigned to the same assignee as the present invention, and which is incorporated herein by reference. As set forth in that patent, the inner cylinder forming the inner surface of the unit is formed from a series of interconnected modular components. The operation of that unit, for its intended purpose, has performed highly satisfactorily. However, it has one minor draw back. When the casting shake-out unit is operated continuously, the wear on the components causes the components or segments to gradually loosen. This requires a retightening of the entire formed inner surface.

It is desirable to enable the machine to operate for a longer period of time before the segments begin to loosen and separate. In U.S. Pat. No. 4,502,808, also assigned to the same assignee as the present invention and which is also incorporated herein by reference, the side edges of the segments were grooved to define a channel between neighboring segments. A pin or bar, which is shaped to have an angle formed therein, is inserted in the channel. In a completed lining, the bars tend to urge the segments apart, thus creating a tight fit in the completed cylindrical lining. This too has worked exceedingly well for its intended purpose, and has enable the shake-out unit to be operated for a longer period of time before the machine had to be shut down to tighten the segments together. However, if a pin wears down, a segment can fall out of the lining. This is obviously undesirable.

SUMMARY OF THE INVENTION

One objective of the present invention is to provide a segmented liner for a shake-out unit.

Another objective of the present invention is to provide a segmented liner also for a rotary separator, media drum, material drier, lump crusher reclaimer, blending drum, and sand screen tumbling mill.

Another objective is to provide such segments which may be easily and quickly assembled into a liner for the shake-out unit or other tumbling mill.

Another objective is to provide such segments which interlock in a manner to prevent a segment from falling out when the pins wear.

Another objective is to provide such segments which will tightly fit together so that the shake-out unit can be operated for a considerable period of time before the liner must be tightened.

These and otherives objects will become apparent to those skilled in the art in light of the following disclosure and accompanying drawings.

In accordance with the invention, generally stated, a casting shake-out unit having an outer cylinder and an inner cylinder is provided. The inner cylinder is formed from a plurality of segments which interfit and interlock with each other to prevent a segment from falling out of the completed inner cylinder. Each segment includes a body having an inner surface, an outer surface, top and bottom edges, and side edges, a tongue extending outwardly from opposing edges of the segments; and pockets formed in edges of the segment. The pockets are formed surface, top and bottom edges, and side edges, a tongue extending outwardly from opposing edges of the segments; and pockets formed in edges of the segment. The pockets are formed such that the pocket of one segment will receive the tongue of a neighboring segment. Preferably, the tongue and pocket are positioned so that the segments will overlap each other, similarly to the manner in which bricks overlap each other in a building. The tongue is positioned at the center of the top and bottom opposing edges and the pockets are formed at corners of the segment. The pockets thus have a width approximately equal to one-half the length of the tongue, and two pockets therefore form a single cavity sized to receive the tongue. In order to make the pocket with a depth approximately equal to the width of the body, the segment it provides with blocks formed at the corners of the outer surfaces of the segment. The pockets are then formed in the block.

DESCRIPTION OF THE PREFERRED EMBODIMENT

Figure 1:
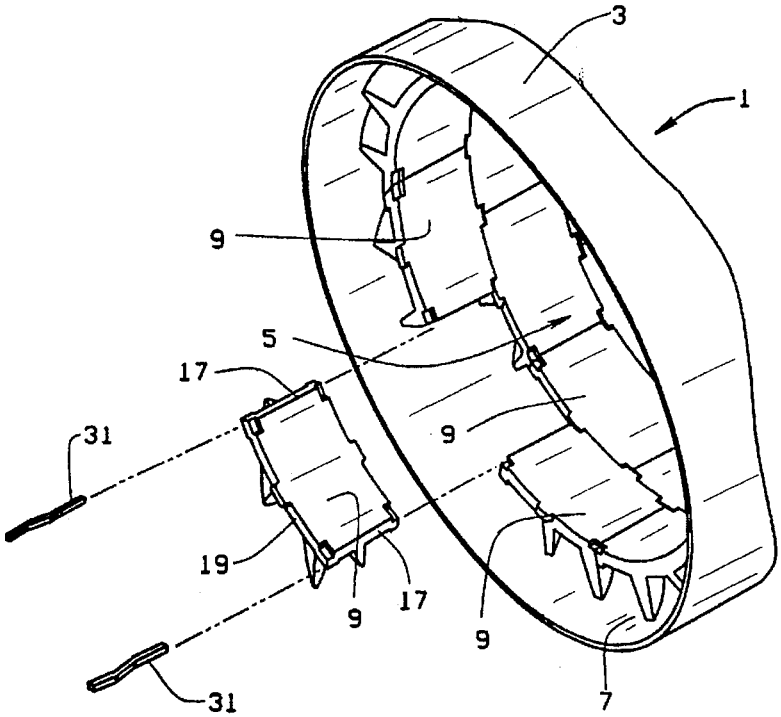
FIG. 1 is a partial perspective end view of a tumbling unit, such as a casting shake-out unit which is partially exploded to show one segment of the lining removed and with inner riflings not shown for purposes of clarity.
Figure 2:
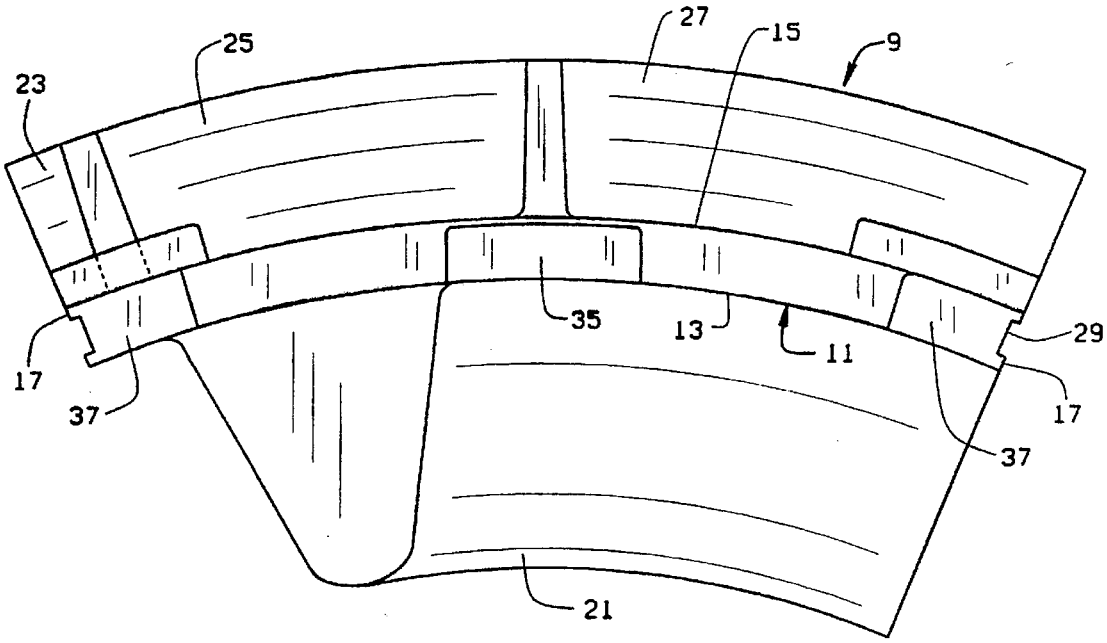
FIG. 2 is a front elevational view of a segment which forms the lining for the tumbling unit.
Figure 3:
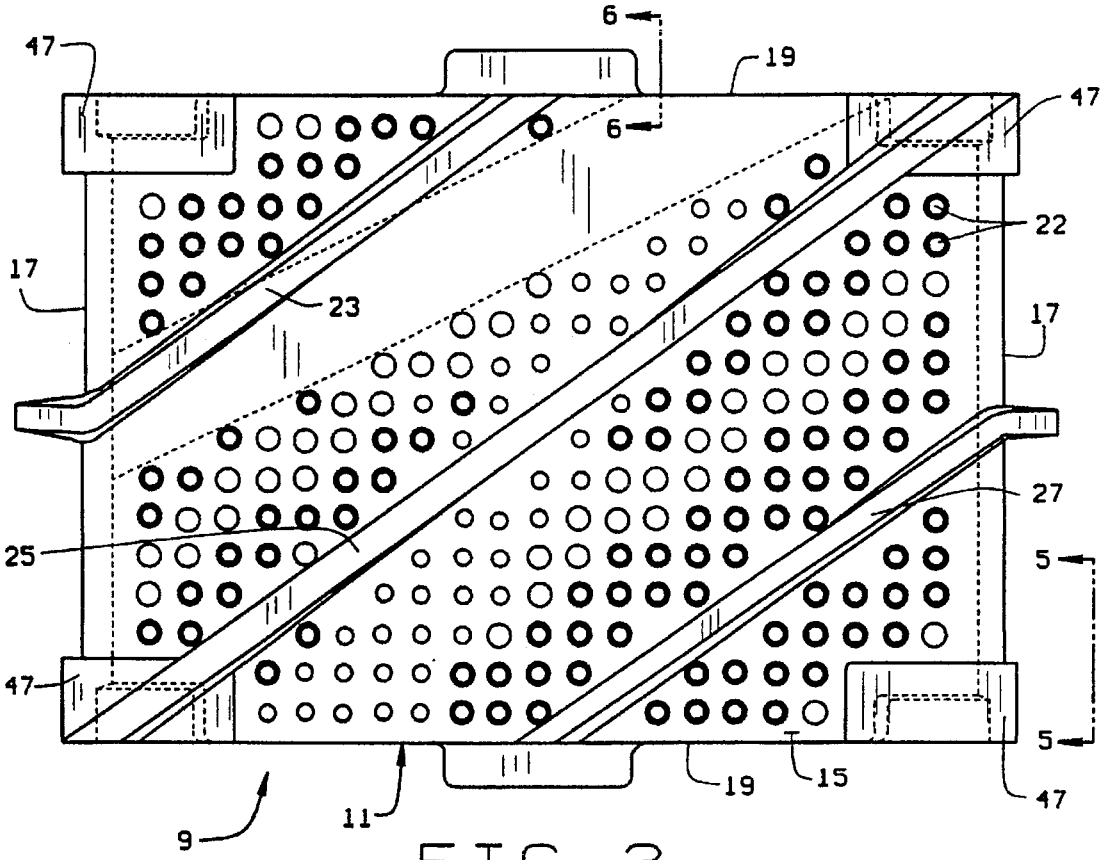
FIG. 3 is a top plan view, showing the outer surface of the segment.

A tumbling mill 1 is shown generally in FIG. 1. Tumbling mill 1 is preferably a mill constructed and operated in the manner disclosed in the above noted U.S. Pat. No. 3,998,262 to remove sand from casting by tumbling the castings. As shown, mill 1 generally includes an outer cylinder 3 and an inner cylinder 5. Inner cylinder 5 is of a smaller diameter than outer cylinder 3, and the two cylinders define a space 7 between the cylinders. The inner liner or cylinder 5 is made of a plurality of interlocking segments 9 which fit together to form the cylinder 5. Importantly, and as will be described below, the segments 9 positively lock together so that segments will not fall out of the lining as they wear. This advantageously increases the time the mill may be continuously operated before it has to be shut down to be tightened.

Figure 5:
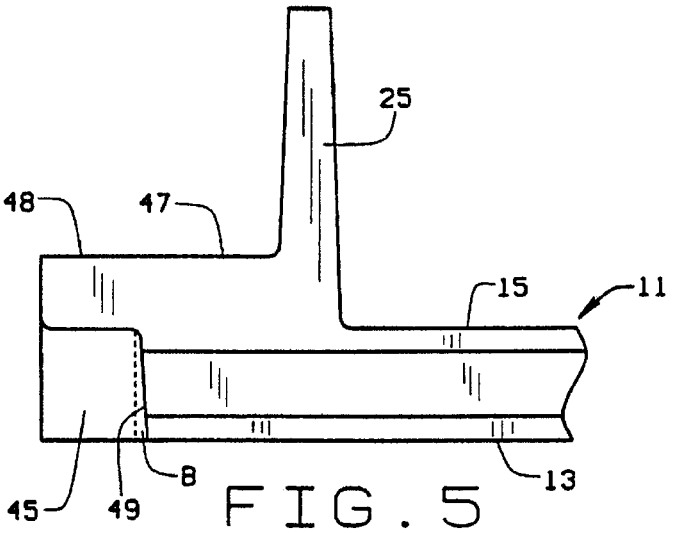
FIG. 5 is a view of the segment taken along line 5—5 of FIG. 3.
Figure 6:
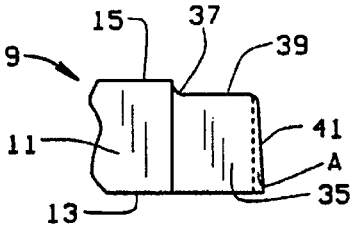
Figure 8:
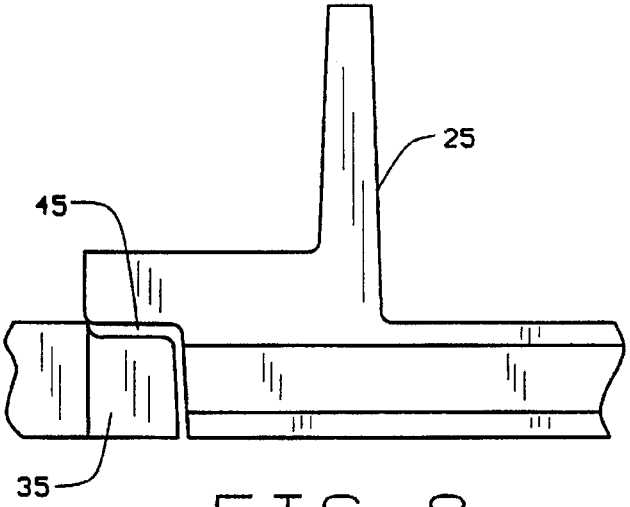
FIG. 8 is a view taken along line 8—8 of FIG. 7 showing the interconnection of segment pieces.
Figure 9:
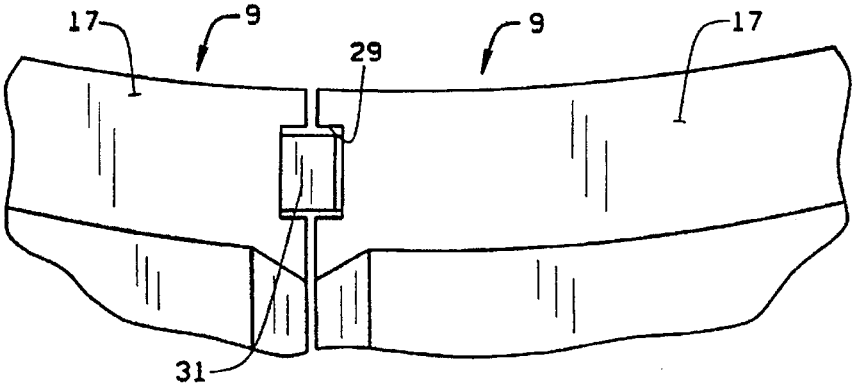
FIG. 9 is a cutaway view showing the interconnection between two segments along their side edges.
Figure 7:
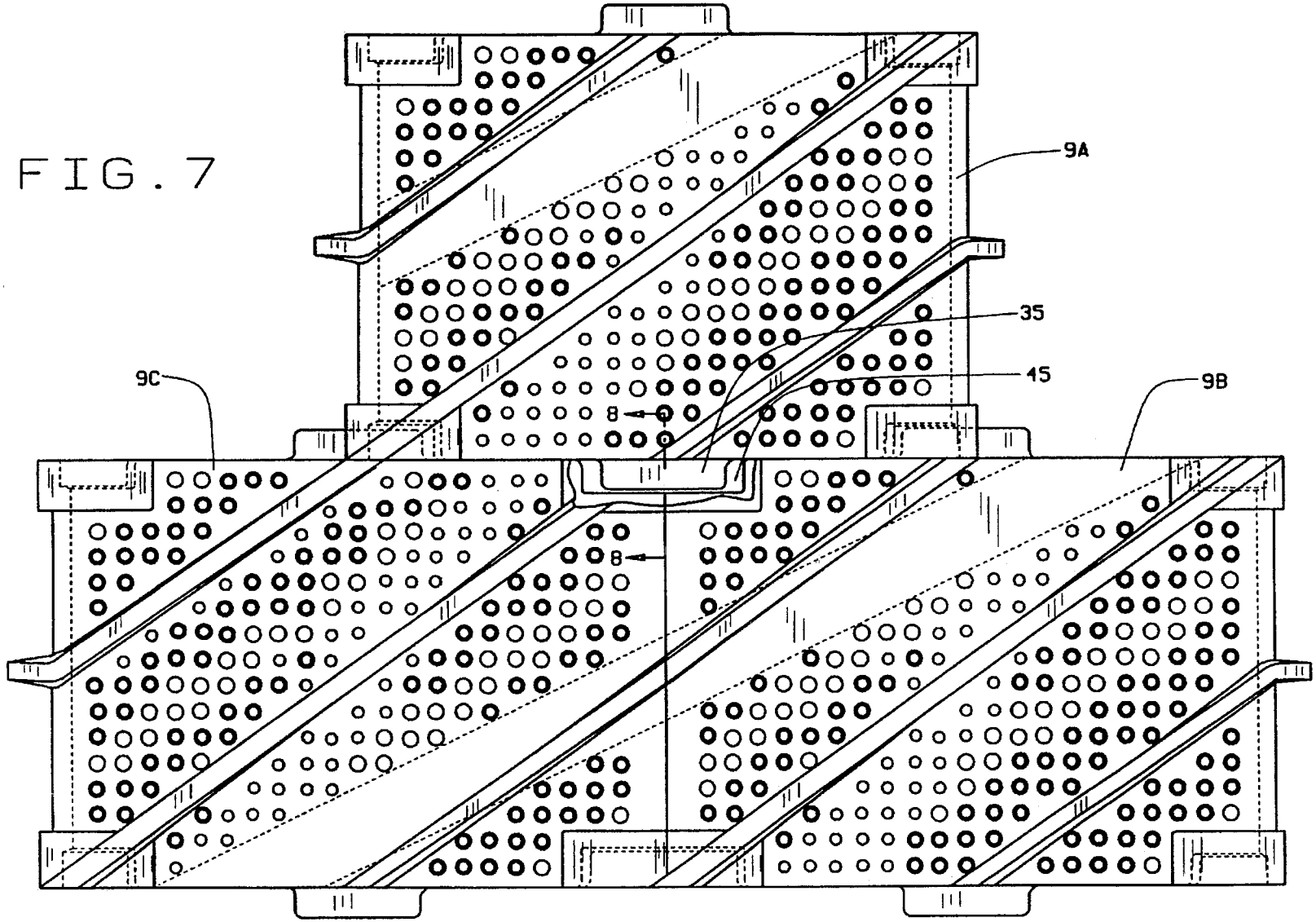

The segment 9 is show in detail in FIGS. 2–6. Each segment 9 includes a generally arcuate body 11 having an inner surface 13, an outer surface 15, side edges 17, and top and bottom edges 19. Each segment preferably covers approximately 45° of arc. The outer surface 15 has a length between sides 17 of about 23.3", the inner surface 13 has a length of about 19.6". To form the inner rifling of the tumbling mill to drive casting through the mill, segment 9 has a diagonally extending rib 21 formed on inner surface 13. As set forth in the prior patents, the inner cylinder 5 is preferably perforated so that the sand which is separated from the castings 15 has a length between sides 17 of about 23.3", the inner surface 13 has a length of about 19.6". To form the inner rifling of the tumbling mill to drive casting through the mill, segment 9 has a diagonally extending rib 21 formed on inner surface 13. As set forth in the prior patents, the inner cylinder 5 is preferably perforated so that the sand which is separated from the castings may fall into space 7 between the inner and outer cylinders. The segments 9 thus have a plurality of holes or perforations 22 formed therein. Outer surface 15 has three ribs 23, 25, and 27 which form the rifling which spaces the inner cylinder from the outer cylinder and which directs the sand through the space 7 to exit the sand from the mill 1. Ribs 23, 25, and 27 are generally parallel and extend diagonally across outer surface 15. Ribs 21, 23, 25, and 27 are positioned on segment 9 so that when a plurality of the segments are connected to form inner cylinder 5, the ribs from one segment abut respective fibs from neighboring segments, as shown in FIG. 7, to provide continuous rifling along the cylinder surface. Ribs 23, 25 and 27 are preferably angled with respect to inner rib 21, preferably to force the sand in the opposite direction of the castings. Although the outer ribs 23, 25, and 27 are angled with respect to the inner rib 21, they could be generally parallel to urge the sand in the stone direction as the castings. A slot or groove 29 is formed along side edges 17 to receive a pin 31 (FIG. 9) which holds spaces the segments apart in the completed inner cylinder to tighten the fit between the segments of the inner cylinder.

To enable the segments 9 to interlock with each other, each segment has a tongue 35 extending from the front and back edges 19. Preferably, tongues 35 are positioned in the middle of the edges. As best seen in FIG. 6, tongue 35 is not as wide as segment body 11, and a small step 37 is formed between the tongue and the body. The step is preferably slightly rounded, to eliminate a sharp corner between the top surface 39 of the tongue and the edge of body 11. The front edge 41 of tongue 35 preferably does not form a right angle with top surface 39. Rather, the front edge forms an angle A of about 3° from the vertical (i.e. an angle of about 93° with tongue top surface 39.

Figure 4:
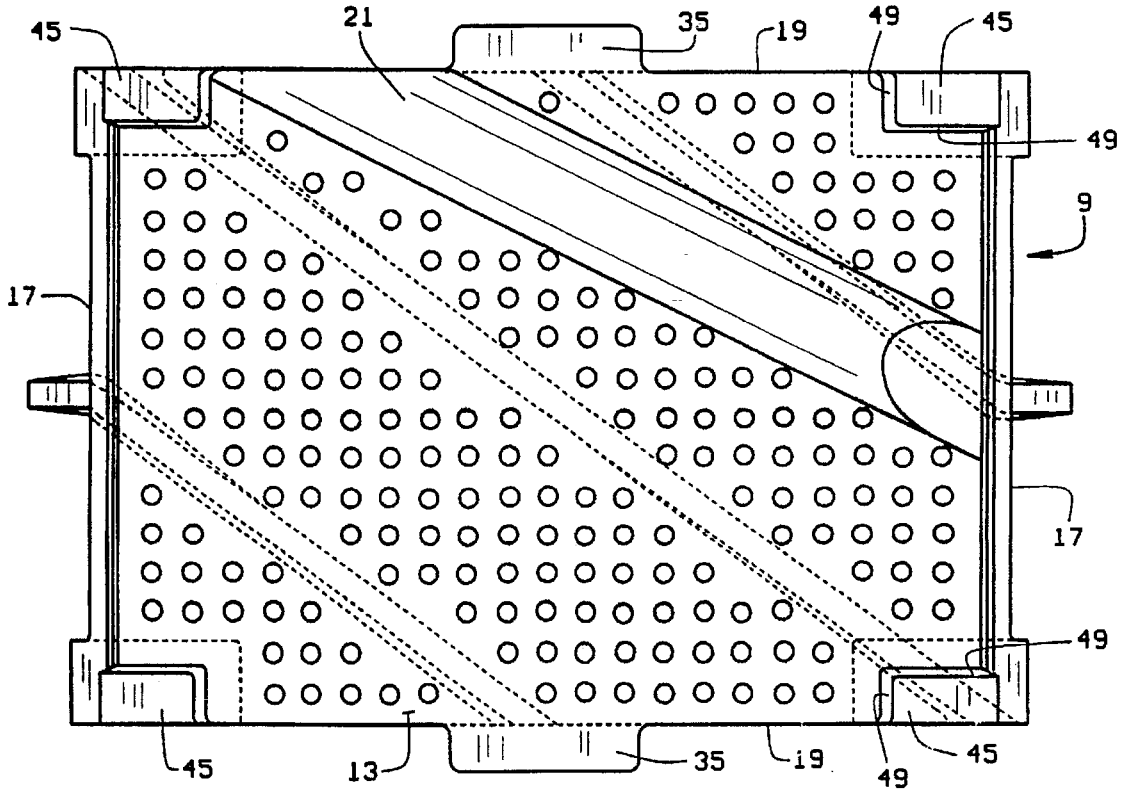
FIG. 4 is a bottom plan view, showing the inner surface of the segment.

Pockets or grooves 45 are formed at the corners of segment body 11 to received tongues 35. Pockets, best shown in FIGS. 4 and 5, are formed in a block 47 formed on upper surface 15. Block 47 forms a built up area at the corners of segment 9 in which pocket 45 is formed so that the pocket can have a width approximately equal to the width of body 11. Preferably, pocket 45 has a depth slightly greater than the length of tongue 35 and a length less than the width of tongue 35. Pocket 45 thus fully receives tongue 35 with respect to the tongue's depth and height. However, the pocket does not fully receive the tongue with respect to its width. Thus, when two segments (9A and 9B) are interconnected, the tongue of segment 9A extends from the pocket of segment 9B, as seen in FIG. 7. Preferably, the pocket 45 has a width approximately equal to one-half the length of the tongue, thus, the tongue of segment 9A is received in the neighboring pockets of segments 9B and 9C, as shown in FIG. 7. The inner edges 49 of pocket 45 are preferably offset from the vertical, to match the compliment the tongue 35. Thus, edge 49 is offset from the vertical by an angle B of about 3°. Although the small offset of 3° is preferred for the edges 41 and 49 of tongue 35 and pocket 45, respectively, any other offset, or no offset at all, could be used.

When the segments are interconnected, the pins tighten the liner or inner cylinder 5, as set forth in the above noted U.S. Pat. No. 4,502,808, to lengthen the time before the segments come loose from each other due to continuous operation of the mill. The interconnection of the segments, in turn, prevents a segment from falling out when the pin wears. The tongue 35 of one segment forms a shelf or seat on which the overhang 48 of block 47 sits. Thus, if a pin 31 wears, the interaction between the tongue and the pocket will prevent the segment from falling out from the inner cylinder 5. Although the segment will be loose when the pin wears through, the segment will not fall out. This will allow the operator time to normally shut down the mill to insert a new pin or a new segment.

As can be appreciated, the segments of the present invention will cooperate with each other to prevent a segment from separating from the lining when a pin wears or breaks. Although the segment may be somewhat loose, the mill 1 will still be operable, at least for a short period of time, before the segment must be replaced. This will allow for a normal shut down of the machine, rather than an emergency shut down of the machine which would be needed if the segment did separate from the lining.

As variations within the scope of the appended claims may be apparent to those skilled in the art, the foregoing description is set forth only for illustrative purposes and is not meant to be limiting. Although the block 47 and pocket 45 are formed on the outer surface 15 of the segment, they could just as easily be formed on the inner surface 13 of the segment. This would, of course, break-up the generally smooth inner surface created with the block 47 formed on segment outer surface 15. Although the tongue is preferably formed at the center of the top and bottom edges, and the pocket is formed at the corners of the segments, the tongues and pockets could be positioned elsewhere along the edges of the segment. Preferably, the placement of the tongue and pockets retain the overlapping of the segments, for example such as is shown in FIGS. 1 and 7. These examples are merely illustrative.

We claim:

1. A casting shake-out unit including an outer cylinder and an inner cylinder, said inner cylinder being formed from a plurality of segments which interfit and overlap with each other, each segment including:

a body having an inner surface, an outer surface, top and bottom edges, and side edges, and each segment having corners;

a tongue extending outwardly from each opposing top and bottom edges of said segment;

pockets formed in edges at corners of said segment, such that the pocket of one segment will receive the tongue of a neighboring segment; said tongue and pocket are positioned so that the segments will overlap each other, said tongue being formed approximately at the center of said opposing edges; each segment includes at least one rib extending generally diagonally along said body inner surface and at least one rib extending generally along said body outer surface, and said ribs of said inner and outer surfaces abutting and aligning with respective ribs of neighboring segments when said inner cylinder is assembled to define vanes in said inner cylinder.

2. The casting shake-out unit of claim 1 wherein each said segment includes a groove extending along at least two opposing edges of said segment, said groove receiving spreaders for spreading neighboring segments to create a tight fit between said segments when said inner cylinder is assembled.

3. The segment of claim 1 including a block formed at said corners, said pockets being formed in said block, said pockets having a depth approximately equal to said body depth, said tongue having a depth slightly less than said body depth.

4. The segment of claim 3 wherein said block is formed on said body outer surface.

5. The segment of claim 1 wherein said tongue has an upper surface and a forward surface; said upper surface being generally horizontal and said forward surface being off set from the vertical.

6. The segment of claim 5 wherein said pocket has an upper surface and an inner surface, said pocket upper surface being generally horizontal and said pocket inner surface being off set from the vertical; said pocket upper and inner surfaces being shaped complementary to said tongue upper and forward surfaces.

7. The segment of claim 6 wherein said tongue forward surface and said pocket inner surfaces are each off set from the vertical by an angle of about 3°, and said surfaces being complementary with each other.

8. The casting shake-out unit of claim 1 wherein said pockets have a width approximately equal to one-half the length of said tongue.

9. The casting shake-out unit of claim 8 including a block formed at said corners, said pockets being formed in said block, said pockets having a depth approximately equal to said body depth, said tongue having a depth slightly less than said body depth.

10. The casting shake-out unit of claim 9 wherein said block is formed on said body outer surface.

11. The casting shake-out unit of claim 8 wherein said tongue has an upper surface and a forward surface; said upper surface being generally horizontal and said forward surface being off set from the vertical.

12. The casting shake-out unit of claim 11 wherein said pocket has an upper surface and an inner surface, said pocket upper surface being generally horizontal and said pocket inner surface being off set from the vertical; said pocket upper and inner surfaces being shaped complementary to said tongue upper and forward surfaces.

13. The casting shake-out unit of claim 12 where in said tongue forward surface and said pocket inner surfaces are each off set from the vertical by an angle of about 3°, and said surfaces being complementary of each other.

14. In a tumbling mill, of the type for use as a casting shake-out unit, rotary separator, media drum, lump crusher, and blending drum, said mill including an outer cylinder and an inner cylinder; said inner cylinder being formed from a plurality of segments which interfit with each other; each segment including:

a body having an inner surface, and an outer surface, top and bottom edges, and side edges;

a tongue extending outwardly and centrally from opposing edges of said segments;

and pockets formed in edges at the corners of said segments, such that the pocket of one segment will receive the tongue of a neighboring segment.

15. A segment for forming an inner lining of a tumbling mill such as a casting shake-out unit, rotary separator, media drum, material dryer, lump crusher reclaimer, blending drum, and sand screen, said segment being shaped and configured to interfit with neighboring segments; said segment including:

a body having an inner surface, an outer surface, top and bottom edges, and side edges;

a tongue extending outwardly and centrally from opposing edges of said segments;

a pocket formed in opposing edges at the corners of said segment; said pocket being sized and shaped to receive at least a part of the tongue from a neighboring segment;

and at least one rib extending generally diagonally along said body inner surface, and at least one rib extending generally along said body outer surface;

said ribs of said inner and outer surfaces abutting respective ribs of neighboring segments when said inner lining is assembled to define vanes in said inner cylinder.

* * * * *